United States Patent [19]

Ōhashi

[11] Patent Number: 4,706,780

[45] Date of Patent: Nov. 17, 1987

[54] LADDER ATTACHING DEVICE

[75] Inventor: Yoshio Ōhashi, Osaka, Japan

[73] Assignee: Kansaka Co., Ltd., Osaka, Japan

[21] Appl. No.: 58,113

[22] Filed: Jun. 4, 1987

[51] Int. Cl.[4] ..... E06C 9/00

[52] U.S. Cl. ..... 182/93; 182/229; 248/225.31

[58] Field of Search ..... 182/93, 229; 248/225.31, 231

[56] References Cited

U.S. PATENT DOCUMENTS

| | | | |
|---|---|---|---|
| 2,854,291 | 9/1958 | Riblet | 182/229 |
| 2,959,388 | 11/1960 | Fogle | 248/231 |
| 2,967,039 | 1/1961 | Garman | 248/231 |
| 3,559,941 | 2/1971 | Holzman | 248/231 |

FOREIGN PATENT DOCUMENTS

| | | | |
|---|---|---|---|
| 786687 | 6/1968 | Canada | 248/231 |
| 245107 | 7/1911 | Fed. Rep. of Germany | 182/93 |
| 2706499 | 8/1978 | Fed. Rep. of Germany | 248/231 |
| 356886 | 10/1961 | Switzerland | 182/93 |

*Primary Examiner*—Reinaldo P. Machado

*Attorney, Agent, or Firm*—Sixbey, Friedman & Leedom

[57] ABSTRACT

A ladder attaching device comprising a bearing member fittable to a corner portion of a column in contact with opposite side surfaces of the portion, a column surrounding fastening belt connected to one side end of the bearing member, a fastener attached to the other side end of the bearing member, and a fixing frame projecting outward from the other side of the bearing member. A ladder is connected to connecting portions of the fixing frame and attached to the column by the bearing portion, the belt and the fastener.

6 Claims, 5 Drawing Figures

LADDER ATTACHING DEVICE

FIELD OF THE INVENTION AND RELATED ART STATEMENT

The present invention relates to a device for attaching a ladder to columns of steel frame structures and the like.

In constructing the steel frame structure of a building, there arises a need for the worker to ascend or descend to various locations to perform the contemplated work.

For this purpose, it has been conventional practice to weld or otherwise attach ascending steps to columns along one side thereof.

However, it is then necessary to attach a large number of steps to the column by a cumbersome procedure, while after the completion of the work, the steps must be removed similarly by a troublesome procedure.

Further because columns are usually interconnected by beams, steps can be attached only to the outer side of the outer columns constituting the steel frame structure. This impose limitations on the location of ascending or descending, entailing a poor construction work efficiency.

OBJECTS AND SUMMARY OF THE INVENTION

The present invention has been accomplished in order to overcome the foregoing problems.

More specifically, a first object of the present invention is to provide a device for readily and removably attaching a ladder to a column for use in climbing up or down.

A second object of the invention is to provide a device by which a ladder can be attached to any one of the component columns of a steel frame structure or the like at any location.

Other objects of the invention will become more apparent from the following description with reference to the accompanying drawings.

To achieve these objects, the invention provides a device for removably attaching to a column a ladder which comprises a pair of opposed side rails and a plurality of steps interconnecting the side rails and arranged at a predetermined spacing.

The ladder attaching device comprises a bearing member fittable to a corner portion of the column in contact with opposite side surfaces of the corner portion, a column surrounding fastening belt having one end connected to one side end of the bearing member, and a fastener attached to the other side end of the bearing member for releasably engaging the free end of the belt. The device can be fastened to the column by winding the fastening belt around the column, engaging the free end of the belt with the fastener and winding up the belt end.

The device further comprises a fixing frame projecting outward from the outer side of the bearing member and having connecting portions, to which the ladder is connected and thereby fixedly held in an upright position within the reentrant angle between the beams to be joined to the column.

DESCRIPTION OF THE PREFERRED EMBODIMENT

Figure 1:
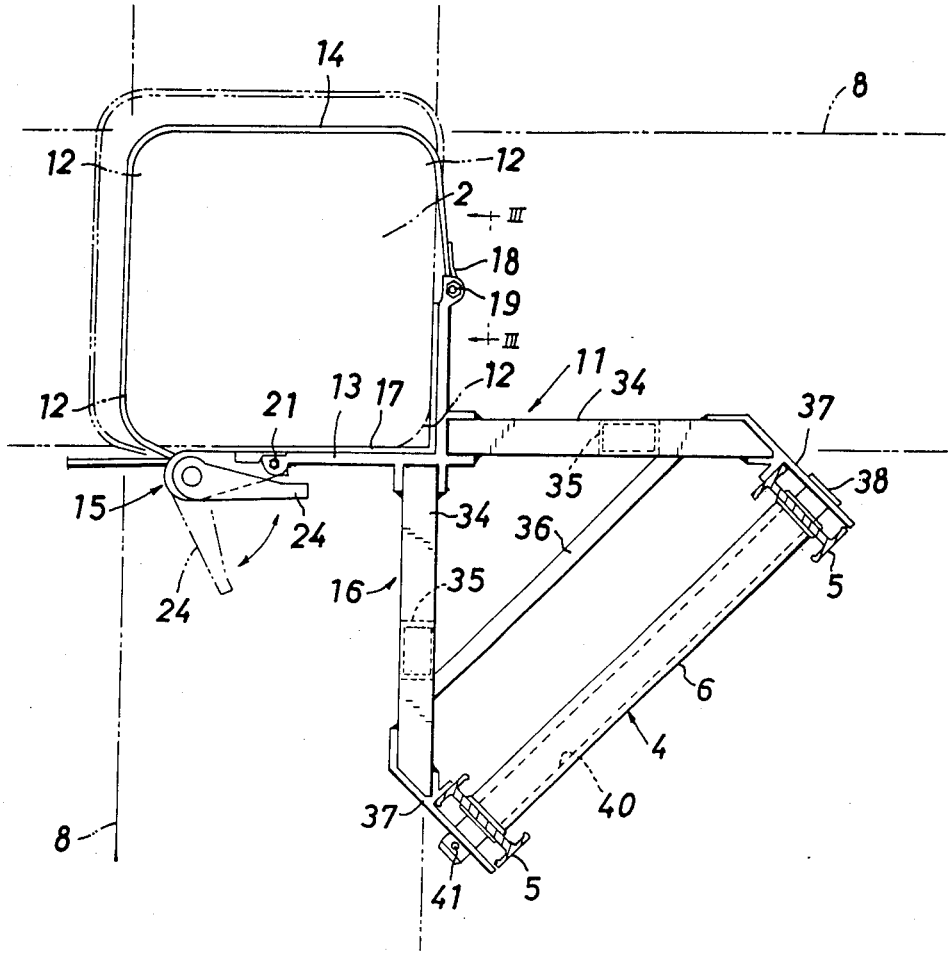
FIG. 1 is a plan view showing an embodiment of the invention.

An embodiment of the present invention will be described below with reference to FIGS. 1 to 5. A ladder 4 made of aluminum or like light alloy comprises a pair of side rails 5, 5 and a plurality of steps 6 interconnecting the side rails 5 and arranged longitudinally thereof at a predetermined spacing. As seen in FIG. 1, each step 6 comprises a tubular pipe.

Columns 2 are each in the form of a pipe or a steel member of H-shaped cross section. The column 2 has connections 9 on two, three or four sides thereof for beams 8. The beams 8 are provided between the opposed connections 9, forming a steel frame structure 1.

A ladder attaching device 11 comprises a bearing member 13 fittable to a corner portion 12 of the column 2 in contact with opposite side surfaces of the portion 12, a fastening belt 14 having a large width and made of nylon strings or the like, a fastener 15 for fastening the belt 14 as passed around the column 2, and a fixing frame 16 for fixedly holding the ladder 4 in place.

Figure 2:
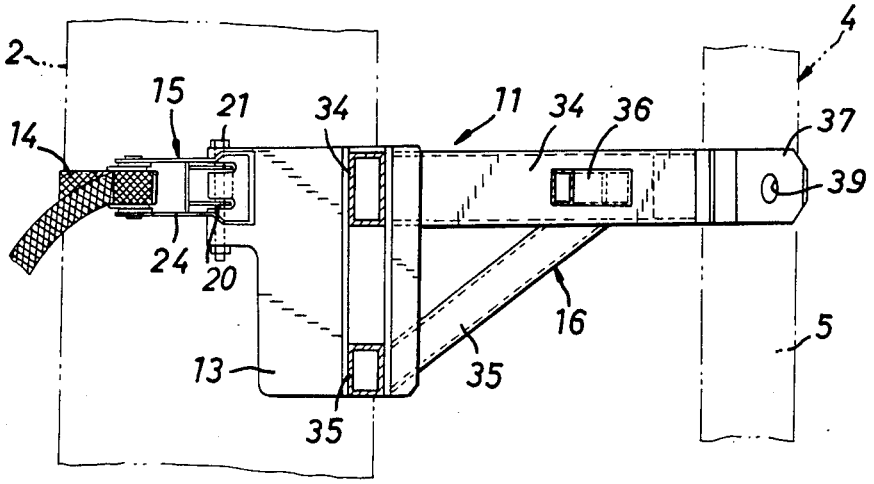
FIG. 2 is a fragmentary side elevation showing the same in section with a ladder removed therefrom.
Figure 4:
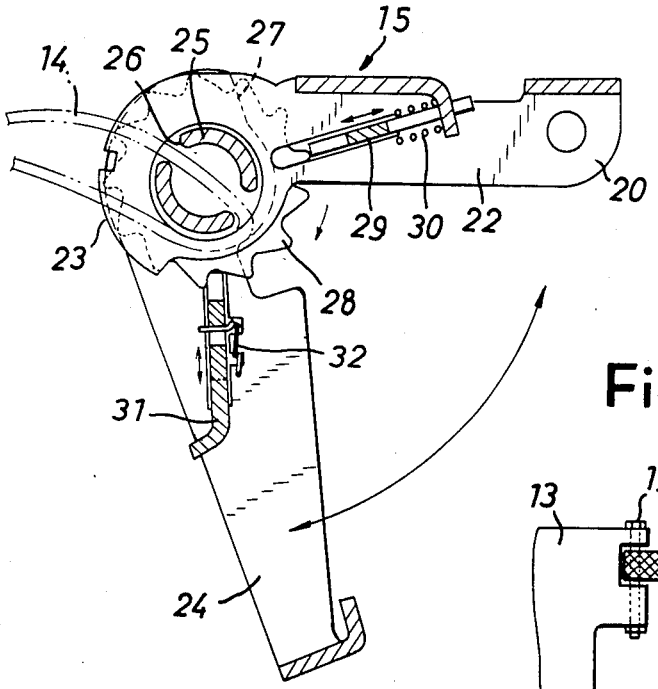
FIG. 4 is a plan view in section showing a fastener.
Figure 3:
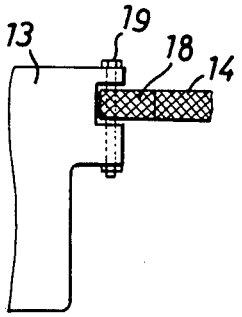
FIG. 3 is a view showing the embodiment as it is seen in the direction of arrows III—III in FIG. 1.

The bearing member 13 is in the form of a plate bent substantially at a right angle when seen from above and is provided with a non-skid rubber sheet 17 on its inner surface. As shown in FIGS. 1 and 3, the belt 14 has a looped end 18 which is connected by a bolt 19 inserted therethrough to one side end of the bearing member 13. As shown in FIGS. 2 and 3, the fastener 15 has connector portions 20 which are connected by a bolt 21 inserted therethrough to the other side end of the bearing member 13.

The fastener 15 comprises a connector 22 connected to the bearing member 13 and having one end, which provides the above-mentioned connector portions 20 vertically opposed to each other. The connector 22 has a pair of upper and lower arm support portions 23 at the other end thereof. The support portions 23 carry a pivot 25 for rotatably supporting a handle arm 24 thereon. Between the arm support portions 23, the pivot 25 is divided into two portions, and the clearance therebetween, i.e. the split portion, serves as an engaging portion 26 for removably inserting therethrough the free end of the fastening belt 14 to engage the belt 14. A ratchet wheel 28 is provided between each of upper and lower connected portions 27 of the handle arm 24 and the arm support portion 23 adjacent thereto. The ratchet wheel 28 is rotatable with the pivot 25. The pivot 25 and the handle arm 24 which are supported by the support portions 23 are rotatable relative to each other about a common axis.

A ratchet 29 is mounted on the connector 22, engageable with or disengageable from the ratchet wheel 28, and biased toward the engaging direction by a spring 30. A rotating pawl 31 is mounted on the handle arm 24 so as to be engageable with the ratchet wheel 28 and is bised in the engaging direction by a spring 32.

The handle arm 24, when pivotally moved, causes the pawl 31 to rotate the ratchet wheel 28 in a specified direction. The rotation of the ratchet wheel 28 rotates the pivot 25 in the same direction, causing the pivot 25 to wind the fastening belt 14 thereon. When the ratchet wheel 28 is released from the ratchet 29 and the pawl 31, the wheel 28, i.e. the pivot 25, is made free to rotate, permitting rewinding of the belt 14.

Thus, the ratchet wheel 28, the ratchet 29 and the pawl 31 provide a ratchet mechanism for intermittently rotating the pivot 25.

The fixing frame 16 is in the form of an assembly of pipe members of square to rectangular cross section. The frame 16 comprises a pair of horizontal members 34 forming a right angle therebetween and projecting outward from the outer side faces of the bearing member 13 at opposite sides of its corner, a reinforcing brace 35 extending from the bearing member 13 to each horizontal member 34, and a member 36 interconnecting the two horizontal members 34. Each horizontal member 34 has at its projecting end a connecting portion 37 to which the ladder 4 is connected and which is formed with a rod hole 39 for inserting a holding rod 38 therethrough.

On the other hand, the opposed side rails 5 of the ladder 4 are each formed with a hole in communication with the hollow interior of each step 6. These holes and hollow provide an insertion bore 40 for inserting the holding rod 38 therethrough.

With one of the steps 6 positioned between the opposed connecting portions 37, the ladder 4 is fixed to the device 11 by the holding rod 38 inserted through the rod holes 39 in the connecting portions 37 and through the insertion bore 40 extending through the side rails 5 and the step 6 as seen in FIG. 1. A suitable retaining pin 41 or the like is attached to the projected end of the rod 38.

As shown in FIG. 1, the horizontal members 34 have a suitable length, such that the ladder 4 fixed to the frame 16 of the device 11 is positioned within the reentrant angle between the beams 8 joined to the column 2.

Figure 5:
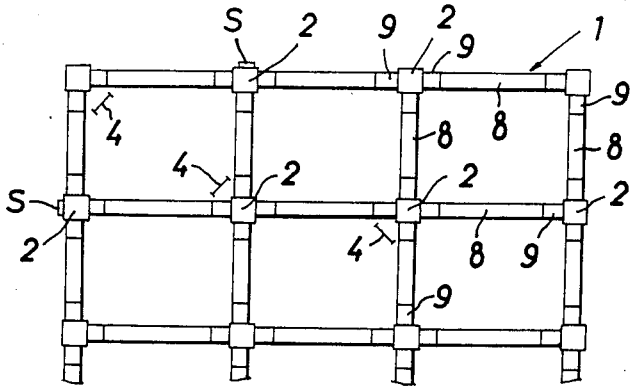
FIG. 5 is a plan view schematically showing ladders installed in place.

When the ladder 4 is to be attached to the column 2, a plurality, for example a pair, of devices 11 embodying the invention as described above are fixed to the ladder 4, for example, at an upper portion and a lower portion thereof suitably spaced apart longitudinally of the side rails 5. The ladder 4 is thereafter fixed to the column 2 as placed on the ground by fitting the bearing portion 13 of each device 11 to the desired corner portion 12 of the column 2, winding the belt 14 around the column 2, engaging the free end of the belt 14 with the engaging portion 26 of the pivot 25 of the fastener 15 and moving the handle arm 24, causing the ratchet mechanism to wind the belt 14 around the pivot 25 from portion to portion, whereby each device 11 can be fixed to the column 2. The column 2 thus having the ladder 4 attached thereto is then installed in the desired position for the construction of the steel frame structure 1. The device 11 can be removed from the column 2 by releasing the ratchet wheel 28 from engagement with the ratchet 29 and the rotating pawl 31. In this way, the ladder 4 can be attached to the column 2 and removed therefrom with ease. According to the conventional practice, steps S can be fixed only to the outer side of outer columns 2 constituting the steel frame structure as shown in FIG. 5, so that ladders can be installed only at limited locations. According to the invention, however, the ladder 4 can be attached to the column 2 without interference with the beams 8 to be joined thereto, utilizing a corner portion 12 of the column 2. The ladder 4 can therefore be attached to a column 2 at any portion of the steel frame structure 1 as shown in FIG. 5. This results in an improved construction work efficiency and a reduced cost. Since the device can be fastened to the column by the belt 14 fitted around the column 2, the device is readily usable for columns of different sizes as indicated in phantom lines in FIG. 1.

What is claimed is:

1. A device for attaching to a column a ladder comprising a pair of opposed side rails and a plurality of steps interconnecting the side rails and arranged at a predetermined spacing, the device comprising a bearing member fittable to a corner portion of the column in contact with opposite side surfaces of the portion, a column surrounding fastening belt having one end connected to one side end of the bearing member, a fastener attached to the other side end of the bearing member for releasably engaging the free end of the fastening belt to wind the belt thereon, and a fixing frame projecting outward from the outer side of the bearing member and having connecting portions connectable to the ladder for fixedly retaining the ladder in an upright position within the reentrant angle between the beams to be joined to the column.

2. A device as defined in claim 1 wherein the fastening belt comprises a striplike member having a large width, and the fastener comprises a connector connected to the bearing member, a pivot and a handle arm both supported by the connector and rotatable relative to each other about a common axis, the pivot having an engaging portion for the fastening belt, and a ratchet mechanism for intermittently rotating the pivot in a a direction to wind the fastening belt by pivotally moving the handle arm.

3. A device as defined in claim 2 wherein the bearing member comprises a plate bent substantially at a right angle when seen from above, and the fixing frame comprises a pair of horizontal members projecting outward at a right angle therebetween from the outer side faces of the bearing member at opposite sides of its corner, the connecting portion being provided on the projecting end of each of the horizontal members.

4. A device as defined in claim 3 wherein the bearing member is provided with a non-skid rubber sheet on its inner side.

5. A device as defined in claim 3 wherein the step of the ladder comprises a tubular pipe, and a bore extends through the side rails and the step, each of the connecting portions of the fixing frame being positionable on the outer side of the corresponding side rail, the ladder being connectable to the connecting portions by a holding rod insertable through a rod hole formed in each of the connecting portions and through the bore of the ladder.

6. A device as defined in claim 4 wherein the step of the ladder comprises a tubular pipe, and a bore extends through the side rails and the step, each of the connecting portions of the fixing frame being positionable on the outer side of the corresponding side rail, the ladder being connectable to the connecting portions by a holding rod insertable through a rod hole formed in each of the connecting portions and through the bore of the ladder.

* * * * *